US009146536B2

(12) United States Patent
Kasapi et al.

(10) Patent No.: US 9,146,536 B2
(45) Date of Patent: Sep. 29, 2015

(54) OSCILLATING MASS PIVOTED ON THE EXTERIOR OF A TIMEPIECE MOVEMENT, TIMEPIECE MOVEMENT FITTED WITH SUCH AN OSCILLATING MASS AND TIMEPIECE COMPRISING SUCH AN OSCILLATING MASS

(75) Inventors: Carole Kasapi, La chaux-de-Fonds (CH); Laurent Dechaumont, La chaux-de-Fonds (CH)

(73) Assignee: CARTIER CREATION STUDIO SA, Geneva (CH)

( * ) Notice: Subject to any disclaimer, the term of this patent is extended or adjusted under 35 U.S.C. 154(b) by 0 days.

(21) Appl. No.: 14/234,436

(22) PCT Filed: Jul. 12, 2012

(86) PCT No.: PCT/IB2012/001364

§ 371 (c)(1),
(2), (4) Date: Jan. 23, 2014

(87) PCT Pub. No.: WO2013/014504

PCT Pub. Date: Jan. 31, 2013

(65) Prior Publication Data

US 2014/0153372 A1 Jun. 5, 2014

(30) Foreign Application Priority Data

Jul. 28, 2011 (EP) ..... 11006204

(51) Int. Cl.
*G04B 5/02* (2006.01)
*G04B 5/18* (2006.01)

(52) U.S. Cl.
CPC . *G04B 5/02* (2013.01); *G04B 5/184* (2013.01)

(58) Field of Classification Search
CPC .. G04B 5/00–5/245; G04B 7/00; G04B 45/02
USPC ..... 368/148, 150, 153, 207–208, 294–295
See application file for complete search history.

(56) References Cited

U.S. PATENT DOCUMENTS 1,981,297 A * 11/1934 Aegler ..... 368/208
2,657,526 A * 11/1953 Gazda ..... 368/148
2,667,737 A * 2/1954 Gazda ..... 368/148
2,857,733 A * 10/1958 Maire ..... 368/208

(Continued)

FOREIGN PATENT DOCUMENTS

CH 142511 9/1930
CH 281 190 2/1952

(Continued)

OTHER PUBLICATIONS

International Search Report dated Oct. 24, 2012, corresponding to PCT/IB2012/001364.

*Primary Examiner* — Amy Cohen Johnson
*Assistant Examiner* — Matthew Powell
(74) *Attorney, Agent, or Firm* — Young & Thompson

(57) ABSTRACT

The oscillating mass able to be fixed to a frame (1) pivoted on the exterior of a timepiece movement has toothing kinematically connected to the ratchet of a barrel of the timepiece movement. This oscillating mass has, on the one hand, a mount (4) which is annular or is in the form of an annular sector and is able to be fixed to the frame (1) and, on the other hand, a central part (7) located mainly or exclusively in one half of the surface delimited by the mount (4).

21 Claims, 3 Drawing Sheets

(56) References Cited

U.S. PATENT DOCUMENTS

| | | | | |
|---|---|---|---|---|
| 3,412,550 | A * | 11/1968 | Delessert et al. | 368/208 |
| 4,910,720 | A * | 3/1990 | Ray et al. | 368/148 |
| 5,377,171 | A * | 12/1994 | Schlup | 368/220 |
| 8,147,128 | B2 | 4/2012 | Jouvenot | |
| 2008/0101163 | A1 * | 5/2008 | Bravo et al. | 368/148 |
| 2009/0129211 | A1 * | 5/2009 | Rochat | 368/208 |
| 2010/0278018 | A1 * | 11/2010 | Jouvenot | 368/208 |
| 2011/0205857 | A1 * | 8/2011 | Beccia et al. | 368/208 |
| 2013/0114381 | A1 * | 5/2013 | Kaelin et al. | 368/208 |

FOREIGN PATENT DOCUMENTS

| | | |
|---|---|---|
| CH | 322 325 | 6/1957 |
| CH | 333 587 | 10/1958 |
| CH | 458213 | 2/1968 |
| CH | 685 363 | 6/1995 |
| DE | 10 2009 005690 | 8/2009 |
| EP | 2 244 138 | 10/2010 |
| FR | 1 046 943 | 12/1953 |
| WO | 03/012556 | 2/2003 |
| WO | 2006/103560 | 10/2006 |
| WO | 2009/056498 | 5/2009 |

* cited by examiner

OSCILLATING MASS PIVOTED ON THE EXTERIOR OF A TIMEPIECE MOVEMENT, TIMEPIECE MOVEMENT FITTED WITH SUCH AN OSCILLATING MASS AND TIMEPIECE COMPRISING SUCH AN OSCILLATING MASS

BACKGROUND OF THE INVENTION

The present invention relates to pivoting or oscillating automatic winding masses pivoted on the exterior of a timepiece movement, as well as to automatic winding timepiece movements and timepieces fitted with such an oscillating or pivoting mass.

DESCRIPTION OF THE RELATED ART

An oscillating mass of this type is known from document DE 10 2009 005 690 which has a circular ring, the inner edge of which is provided with toothing intended to be kinematically connected to the ratchet of a barrel. The upper surface of this circular ring bears the winding mass itself which is in the form of a crown sector having an angular span of preferably 180°.

Unless the height or diameter of a movement fitted with such an automatic winding mass pivoted on the exterior of the movement is considerably increased, the power and efficiency of the automatic winding system are low, the dimensions and thus the weight of the mass being greatly reduced.

An oscillating mass intended to be pivoted by a ball bearing on the exterior of a timepiece movement is also known from document CH 458213. This mass also has the form of an annular sector having an angular extent of the order of 180°. However, this embodiment has the same disadvantages as those stated above in relation to the embodiment described in document DE 10 2009 005 690.

SUMMARY OF THE INVENTION

The aim of the present invention is to enable the formation of an automatic winding timepiece movement, the oscillating mass of which, pivoted on the exterior of the movement, can have a greater weight for dimensions given by the diameter and height of the timepiece movement so as to achieve an automatic winding mechanism which is more powerful and effective than the known devices.

Another aim of the present invention is to provide, by way of the shape of the oscillating mass pivoted on the exterior of a timepiece movement, such a movement with a visual and aesthetic effect which is new, fun and attractive.

The object of the present invention is an oscillating mass able to be fixed to a frame pivoted on the exterior of a timepiece movement and having toothing kinematically connected to the ratchet of a barrel of said timepiece movement, characterised in that the oscillating mass has, on the one hand, a mount which is annular or is in the form of an annular sector and is able to be fixed to said frame and, on the other hand, a central part located mainly or exclusively in one half of the surface delimited by said mount.

Still another object of the present invention is an automatic winding timepiece movement having an oscillating mass fixed to a frame pivoted on the exterior of the timepiece movement, this frame having toothing meshing with a kinematic link connecting it to the ratchet of a barrel of the timepiece movement; characterised in that the oscillating mass has, on the one hand, a mount which is annular or is in the form of an annular sector and is able to be fixed to said frame and, on the other hand, a central part located mainly or exclusively in one half of the surface delimited by said mount.

Still another object of the present invention is an automatic winding timepiece, in particular a wristwatch, comprising a timepiece movement and hands, characterised in that the movement has an automatic winding mechanism, the oscillating mass of which is formed in accordance with any one of the preceding claims, and in that the central part of the oscillating mass moves on the same side of the movement as the hands but does not thereby interfere therewith.

BRIEF DESCRIPTION OF THE DRAWING FIGURES

The accompanying drawing illustrates schematically and by way of example an oscillating mass intended to be pivoted on the exterior of a timepiece movement, and illustrates partially a timepiece movement fitted with such an oscillating mass.

FIG. 1 is a perspective view of one embodiment of an oscillating mass in accordance with the invention fixed to the inner frame of a ball bearing, the outer frame 2 of which is fixed to the peripheral part of the plate 3 of a timepiece movement, in particular a wristwatch.

DETAILED DESCRIPTION OF THE INVENTION

Figure 1:
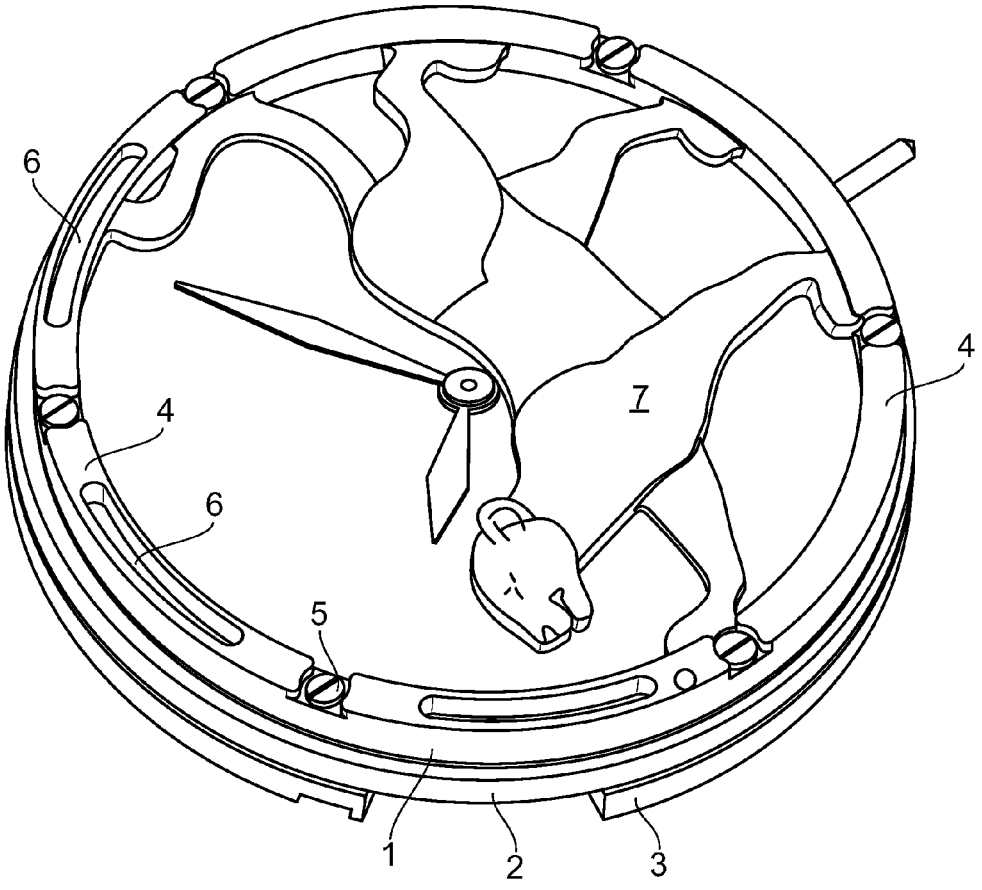
FIG. 1 is a perspective view of the oscillating mass pivoted on the exterior of a timepiece movement by a ball bearing.

This oscillating mass has an annular mount 4 intended to be fixed by screws 5 to the upper part of the inner frame 1 of a ball bearing. In the illustrated embodiment (as can be seen particularly clearly in FIG. 2), the annular mount 4 has a thicker (and thus heavier) part and a thinner (and thus lighter) part and it is also provided with openings 6 in and along the thinner and lighter part. In this manner, the weight of the annular mount 4 is not distributed uniformly and the annular mount thus has an unbalance. The effect of the unbalance can also be obtained by other means known to the person skilled in the art—for example by using materials of different weights for the heavier and lighter parts respectively (either instead of or in combination with the means described above).

This oscillating mass also has a central part 7 located mainly or even exclusively in the part of the surface delimited by the heavier part of the annular mount 4. This central part 7 is fixed at one or several points to the heavier part of the annular mount 4. Preferably, the central part 7 is located mainly or exclusively in one half of the surface delimited by the annular mount 4. This central part 7 of the oscillating mass can, of course, also be made in one piece with the annular outer mount 4.

In this manner, the oscillating mass can have a large unbalance (which, preferably, is added to the unbalance of the mount 4) corresponding at least to the weight of the central part 7 of the oscillating mass which provides increased power and efficiency for the oscillating mass for winding an automatic winding mechanism of a timepiece movement.

The central part of the oscillating mass may have any shape but is preferably in the shape of a figure, such as a panther in the illustrated embodiment.

In such an oscillating mass, the unbalance is much greater than for an oscillating mass which is annular or in the form of an annular sector as is currently known. Preferably, the central part 7 of the mass takes up, at the most, half of the surface delimited by the annular mount 4 of the oscillating mass but for some desired shapes of the central part 7 it could extend into the other half so long as its unbalance effect is not adversely affected to a significant extent.

In variations, the mount of the mass can comprise an annular sector having an angular extent less than 360° (e.g., of the order of 180°. The weight of such a mount can be distributed uniformly or it can be lighter towards its ends. The central part of the mass can be fixed to or connected to this mount as described above.

Figure 2:
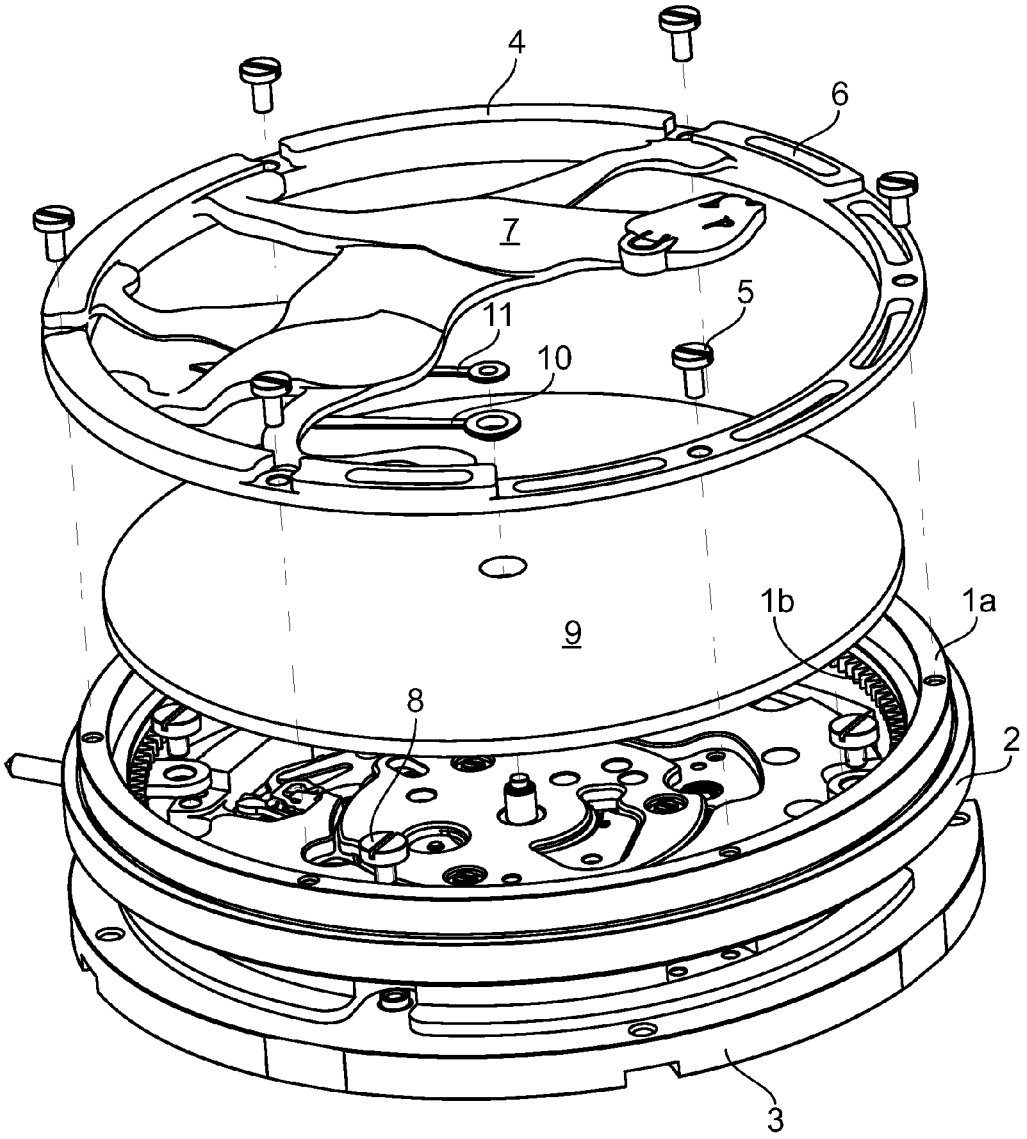
FIG. 2 is a partial, exploded view of a timepiece movement fitted with an oscillating mass pivoted on the exterior of said movement.
Figure 3:
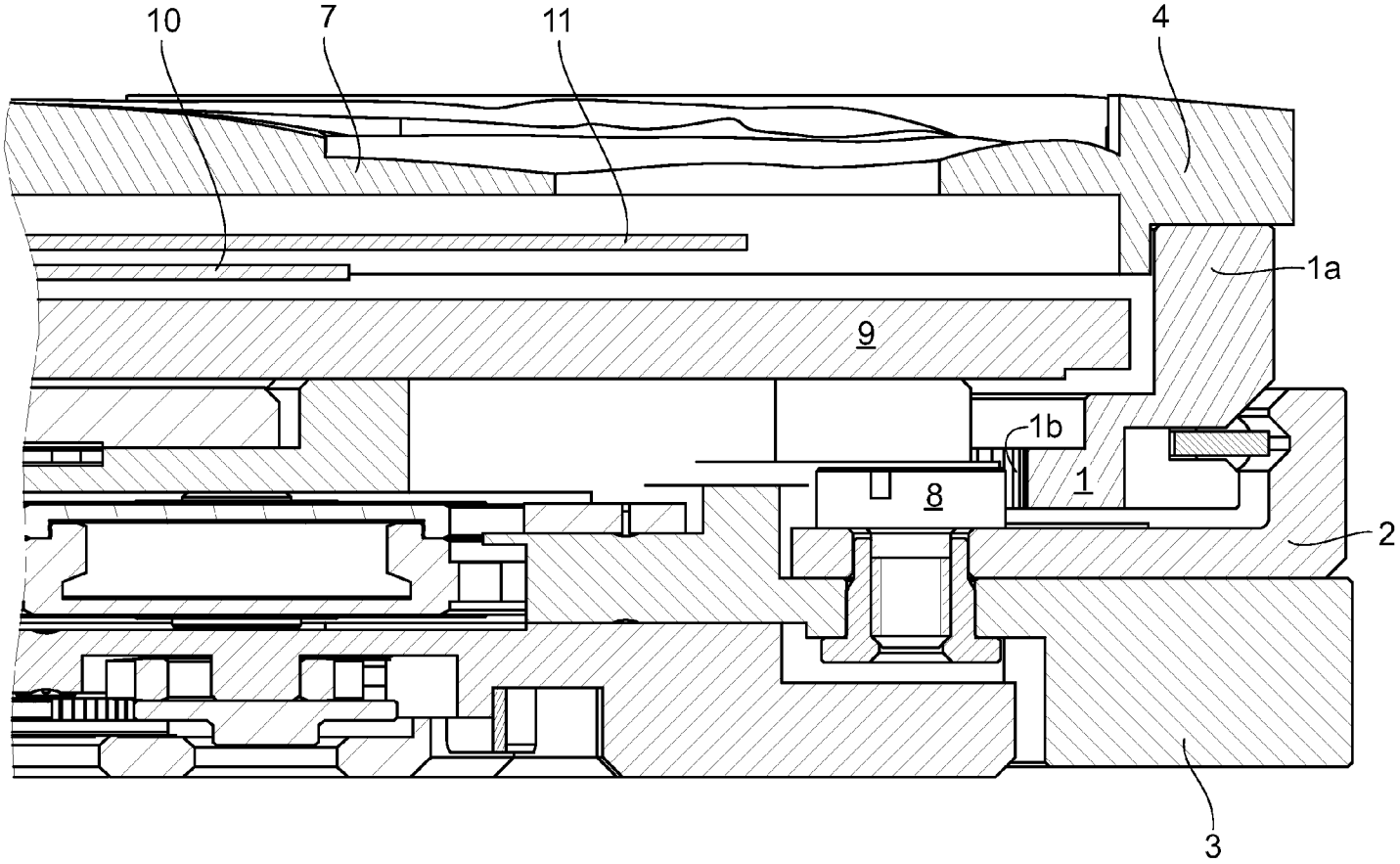
FIG. 3 is a partial, cross-sectional view of a timepiece movement fitted with an oscillating mass pivoted on the exterior of said movement.

FIGS. 2 and 3 illustrate schematically and partially a timepiece movement fitted with an oscillating mass as described above.

The outer frame 2 of the ball bearing is fixed to the plate 3 of the timepiece movement using screws 8. The inner frame 1 of the ball bearing has a cylindrical upper part 1*a* surrounding the dial 9 of the timepiece movement, the upper surface thereof being located in a plane in parallel with the dial 9 but above the hands 10, 11 of the time display of the timepiece movement.

Preferably, the oscillating mass 4, 7 is fixed by screws 5 to the cylindrical part 1*a* of the inner frame of the ball bearing such that the central part 7 of the oscillating mass moves above the hands of the timepiece movement. In this manner, the central mass 7 of the oscillating mass is such that it does not interfere with the spindle(s) of the hands of the movement but moves above the dial and hands.

The shape of the central part 7 of the oscillating mass is preferably such that, regardless of its angular position with respect to the movement during operation thereof, the spindle (s) of the hands of the time display of said movement is(are) always out of the sweeping area of this central part 7 and thus of the oscillating mass 4, 7.

Thus, in one alternative embodiment, the plane in which the oscillating mass 4, 7 moves can be in parallel with the dial 9 but located between said dial 9 and the hands 10, 11. In such an embodiment, the hands 10, 11 are always fully visible for the user of the watch having such an oscillating mass for its automatic winding mechanism.

Of course, the dial can also be omitted, as in a skeleton watch, and in this case the central part of the mass would be located between the plate and the hands 10, 11 in this variation.

The central part (7) of the oscillating mass moves on the same side of the movement as the hands whilst not interfering therewith.

A watch having a movement fitted with an oscillating mass in accordance with the present invention allows efficient and powerful winding of its barrel on the one hand and has completely new, original, fun and attractive aesthetics on the other hand.

As can be seen in FIGS. 2 and 3, the lower part of the inner ring 1 of the ball bearing has toothing 1*b* meshing with a kinematic link connecting it to the ratchet of a barrel of the movement in a manner well known to the person skilled in the art.

The invention claimed is:

1. An automatic winding timepiece movement comprising:

a frame (1, 2) pivotably fixable on and above a radially outermost peripheral part of an exterior of a timepiece movement, the frame having toothing (1*b*) that meshes with a kinematic link connecting the toothing (1*b*) to a ratchet of a barrel of the timepiece movement; and an oscillating mass (4, 6, 7) fixed to the frame (1) such that all of the oscillating mass is pivoted outside of and above all internal gearing components of the timepiece movement, wherein the oscillating mass is comprised of i) a mount (4) fixed to said frame (1) and ii) a central part (7) located mainly or exclusively in one half of a surface delimited by said mount (4), and located overhanging a part of the dial (9) and a part of the internal gearing components of the timepiece movement.

2. The automatic winding timepiece movement as claimed in claim 1, wherein the frame is a ball bearing comprised of i) an outer frame (2) with a lower surface that fixes to an upper surface of a peripheral part of a plate (3) of a wristwatch such that the oscillating mass is pivoted outside and above the timepiece movement, and ii) an inner frame (1) which includes the toothing (1*b*).

3. The automatic winding timepiece movement as claimed in claim 2, wherein the mount (4) is an annular mount with a lower surface fixed to an upper surface of the inner frame.

4. The automatic winding timepiece as claimed in claim 2, wherein the mount (4) has an annular sector with a lower surface fixed to an upper surface of the inner frame.

5. An oscillating mass fixable to a frame (1) pivoted on a radially outermost exterior of a timepiece movement and having toothing kinematically connected to the ratchet of a barrel of said timepiece movement, the oscillating mass comprising:

a mount (4) which is annular or has an annular sector and is able to be fixed to said frame (1) and, a central part (7) located mainly or exclusively in one half of the surface delimited by said mount (4), wherein the oscillating mass is fixed to the frame (1) of the timepiece movement, and all of both the frame and the oscillating mass are pivoted outside and above all internal gearing components of the timepiece movement, and wherein the oscillating mass is located overhanging a part of a dial (9) of the timepiece.

6. The oscillating mass as claimed in claim 5, wherein the annular mount (4) also forms an unbalance and comprises a heavier part and a lighter part, the central part (7) being fixed at one or several points to the heavier part of the annular mount (4).

7. The oscillating mass as claimed in claim 6, wherein the annular mount has openings (6) distributed over the lighter part.

8. The oscillating mass as claimed in claim 6, wherein the central part (7) is made in one piece with the mount (4).

9. The oscillating mass as claimed in claim 6, wherein the central part (7) represents a figure.

10. The oscillating mass as claimed in claim 5, wherein the central part (7) is made in one piece with the mount (4).

11. The oscillating mass as claimed in claim 5, wherein the central part (7) moves freely from the timepiece movement.

12. An automatic winding timepiece comprising the automatic winding timepiece movement of claim 5, the timepiece movement comprising hands (10, 11), an automatic winding mechanism, wherein the central part (7) of the oscillating mass moves on a same side of the movement as the hands (10, 11) but does not thereby interfere therewith.

13. The automatic winding timepiece as claimed in claim 12, wherein the frame (1) pivots the oscillating mass (4, 7) on the exterior of the movement, and the frame is a ball bearing (1, 2).

14. The automatic winding timepiece as claimed in claim 13, wherein the oscillating mass (4, 7) is fixed to an inner frame (1) of the ball bearing, and an outer frame (2) of the ball bearing is fixed to the radially outermost exterior of the timepiece movement, the radially outermost exterior of the timepiece movement being an upper surface of a radial periphery of a plate (3) of the movement.

15. The automatic winding timepiece as claimed in claim 14, wherein the inner frame (1*a*) of the ball bearing has inner toothing driving, via a kinematic link, the ratchet of a barrel of the movement.

16. The automatic winding timepiece as claimed in claim 13, wherein an inner frame (1*a*) of the ball bearing has inner toothing driving, via a kinematic link, the ratchet of a barrel of the movement.

17. The automatic winding timepiece as claimed in claim 12, wherein a movement plane in which the central part (7) of the oscillating mass (4, 7) moves is in parallel with the dial (9) of the timepiece, the hands (10, 11) being located between the movement plane of the central part (7) of the oscillating mass and the dial (9) or the plate.

18. The automatic winding timepiece as claimed in claim 12, wherein, a movement plane in which the central part (7) of the oscillating mass (4, 7) moves is in parallel with the dial (9) of the timepiece, the movement plane of the central part (7) of the oscillating mass being located between the dial (9) or the plate and the hands (10, 11); and a spindle(s) of the hands is(are) located out of the sweeping area of the central part (7) of the oscillating mass.

19. The oscillating mass as claimed in claim 5, in combination with the frame, wherein, the frame is an annular frame (1, 2) pivotably fixably outside and above the exterior of the timepiece movement of a wristwatch, and the frame is comprised of i) an outer frame (2) with a lower surface that fixes to an upper surface of a peripheral part of a plate (3) of a wristwatch such that the oscillating mass is pivoted outside and above the timepiece movement, and ii) an inner frame (1) which includes toothing (1*b*) that meshes with a kinematic link connecting the toothing (1*b*) to a ratchet of a barrel of the timepiece movement.

20. An automatic winding timepiece movement comprising:

a ball bearing having an inner ring and an outer ring (2), a lower surface of the outer ring being fixable to an upper surface of a plate (3) that is a radially outermost peripheral portion of a timepiece movement, the timepiece movement further comprising a dial (9), hands (10, 11), and an automatic winding mechanism with internal gearing components including a winding gear;

a frame (1) mounted to and above the inner ring of the ball bearing such that, via the ball bearing, the frame is pivotably fixed above the upper surface of the plate (3), the frame having toothing (1*b*) that meshes with a kinematic link connecting the toothing (1*b*) to a ratchet of a barrel of the timepiece movement, a radially inside perimeter (1*a*) of the frame surrounding a radially outside perimeter of the dial (9);

an oscillating mass (4, 6, 7) located above the dial (9) and fixed to the frame (1) pivoted such that all of the oscillating mass is pivoted outside and above all the internal gearing components of the timepiece movement, wherein the oscillating mass is comprised of i) an annular mount (4) fixed to an upper surface of said frame (1) and ii) a central part (7) located mainly or exclusively in one half of a surface delimited by said mount (4) and is located overhanging a part of the dial (9) and a part of the internal gearing components of the timepiece movement.

21. The automatic winding timepiece movement of claim 20, wherein central part of the oscillating mass moves freely from the timepiece movement, the central part of the oscillating mass not being directly connected to the winding gear of the timepiece movement.

* * * * *